US007934937B1

(12) United States Patent
Gillette et al.

(10) Patent No.: US 7,934,937 B1
(45) Date of Patent: May 3, 2011

(54) CONNECTOR ASSEMBLY HAVING AN OPEN VOLUME BETWEEN THE ASSEMBLY AND A CIRCUIT BOARD

(75) Inventors: Candace Eileen Gillette, Fremont, CA (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/685,712

(22) Filed: Jan. 12, 2010

(51) Int. Cl.
*H01R 13/533* (2006.01)

(52) U.S. Cl. ..... 439/191; 439/76.1; 439/485; 439/490; 439/676

(58) Field of Classification Search ..... 439/76.1, 439/191, 485, 490, 676
See application file for complete search history.

(56) References Cited

U.S. PATENT DOCUMENTS

| | | | | |
|---|---|---|---|---|
| 4,756,696 | A * | 7/1988 | Whiteman, Jr. | 439/79 |
| 5,046,952 | A * | 9/1991 | Cohen et al. | 439/63 |
| 5,066,236 | A * | 11/1991 | Broeksteeg | 439/79 |
| 5,613,873 | A * | 3/1997 | Bell, Jr. | 439/490 |
| 5,685,737 | A * | 11/1997 | Morin et al. | 439/490 |
| 6,464,533 | B1 * | 10/2002 | Ma et al. | 439/490 |
| 6,863,566 | B2 * | 3/2005 | Scheuerer | 439/587 |
| 6,913,481 | B2 * | 7/2005 | Marshall et al. | 439/490 |
| 7,175,443 | B2 * | 2/2007 | Mizuno et al. | 439/76.1 |
| 7,648,385 | B2 * | 1/2010 | Wu | 439/490 |
| 7,789,713 | B2 * | 9/2010 | Slepov | 439/676 |
| 2009/0149060 | A1 * | 6/2009 | Zhu et al. | 439/485 |
| 2010/0093208 | A1 | 4/2010 | Hamner et al. | |

* cited by examiner

*Primary Examiner* — James Harvey

(57) ABSTRACT

A connector assembly includes a body and one or more contacts. The body extends along a longitudinal axis between front and back ends and along a vertical axis between a top surface and bottom surfaces. The body has a mating section, a raised section, and a mounting section. The contact is disposed in the body and is configured to electrically couple with the mating connector and with the circuit board. The raised section is spaced apart from and is suspended above the circuit board when the mounting section is mounted to the circuit board.

19 Claims, 5 Drawing Sheets

CONNECTOR ASSEMBLY HAVING AN OPEN VOLUME BETWEEN THE ASSEMBLY AND A CIRCUIT BOARD

BACKGROUND OF THE INVENTION

The subject matter herein relates generally to connector assemblies, and more particularly, to connector assemblies that are mounted to circuit boards.

Connector assemblies such as RJ-45 connectors may be board-mounted connectors in that the connectors are mounted to circuit boards. The connectors include a front end that mates with another connector, or mating connector, and a side or surface that is mounted to the circuit board. One or more contacts are disposed within the connector. Contacts near the front end mate with corresponding contacts in the mating connector. Contacts near the back end are coupled with the circuit board. When the mating connector mates with the board-mounted connector, the mating connector is electrically coupled with the circuit board, either directly or through electronic components internal to the board-mounted connector.

In some devices, the circuit board to which the connector is mounted has limited real estate for mounting electronic components near or around the board-mounted connectors. Typically, additional electronic components such as light emitting diodes and other components must be mounted to the circuit board outside of the footprint of the connector assembly. For example, the footprint that represents the real estate on the circuit board that is consumed by the connector assembly when the connector assembly is mounted to the circuit board may not be available for mounting other electronic components.

As a result, the additional electronic components may be mounted to the circuit board in areas around or adjacent to the connector assembly. The mounting of the additional electronic components near the connector assembly consumes the limited real estate of the circuit board. The size of the circuit board may be limited. Consequently, the footprint of the connector assembly reduces the real estate of the circuit board on which additional electronic components may be mounted.

A need exists for a connector assembly that may be mounted to a circuit board without substantially reducing circuit board real estate that is available for other electrical components.

BRIEF DESCRIPTION OF THE INVENTION

In one embodiment, a connector assembly is provided. The connector assembly includes a body and one or more contacts. The body extends along a longitudinal axis between front and back ends and along a vertical axis between a top surface and bottom surfaces. The body has a mating section, a raised section, and a mounting section. The contact is disposed in the body and is configured to electrically couple with the mating connector and with the circuit board. The raised section is spaced apart from and is suspended above the circuit board when the mounting section is mounted to the circuit board In another embodiment, another connector assembly is provided. The connector assembly includes a body and one or more contacts. The body extends along a longitudinal axis between front and back ends and along a vertical axis between a top surface and bottom surfaces. The body has a top side and a bottom side and is staged in height dimensions along the vertical axis between the top side and the bottom surfaces to define a mating section, a raised section, and a mounting section. The mating section includes the front end and is configured to couple with a mating connector. The mounting section is configured to be joined to a circuit board. The contact is disposed in the body and is configured to electrically couple with the mating connector and with the circuit board. The bottom surface of the mounting section is configured to engage the circuit board when the body is mounted to the circuit board such that the raised section is suspended above and spaced apart from the circuit board and the body defines a component retention tunnel laterally traversing between the raised section and the circuit board.

DETAILED DESCRIPTION OF THE INVENTION

Figure 1:
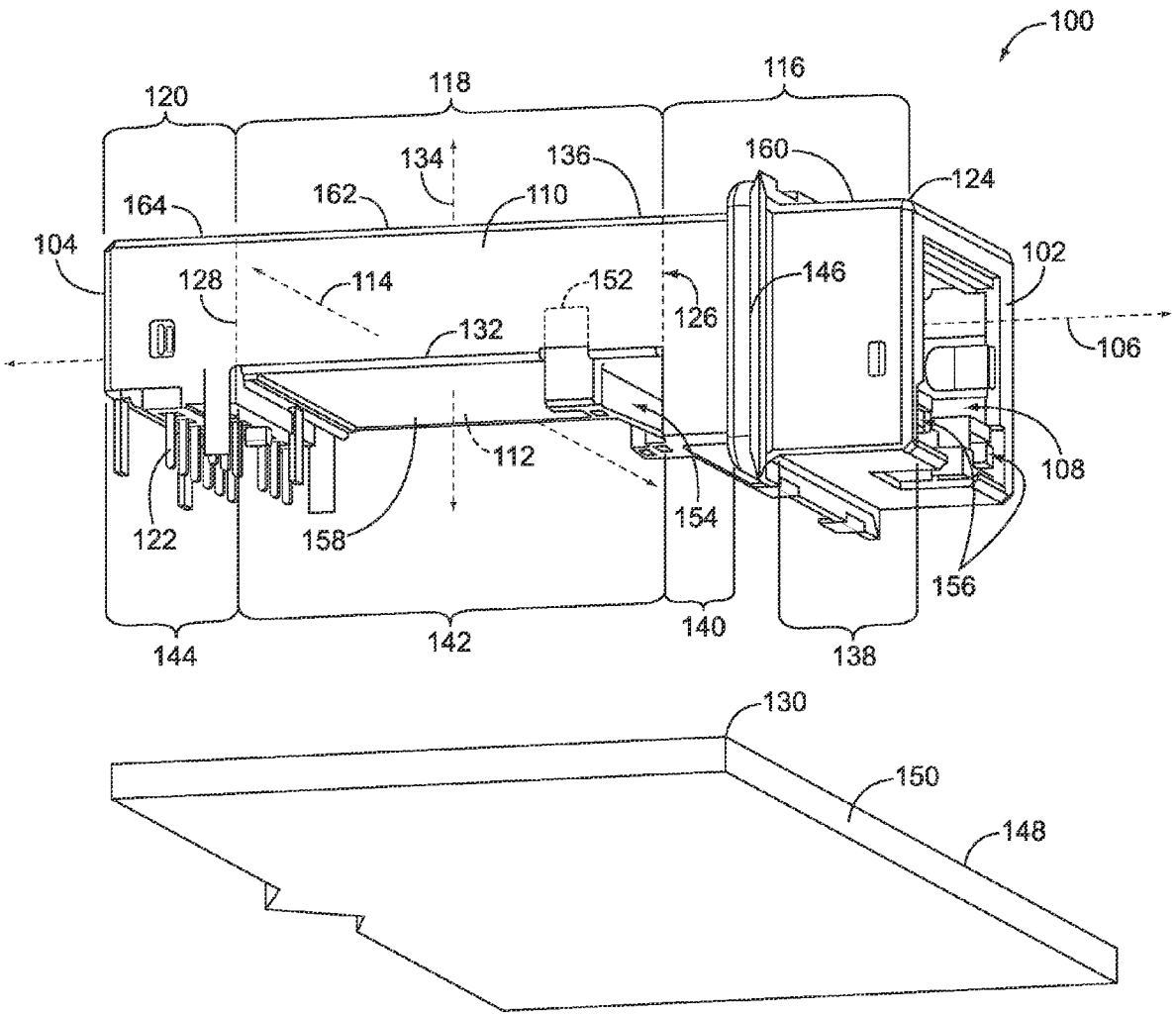
FIG. 1 is a perspective view of a connector assembly in accordance with one embodiment of the present disclosure.

FIG. 1 is a perspective view of a connector assembly 100 in accordance with one embodiment of the present disclosure. The connector assembly 100 is a receptacle connector that is mounted to a circuit board 130 and that mates with a plug end of an RJ-45 connector in the illustrated embodiment. Alternatively, the connector assembly 100 is configured to mate with a different type of connector or a connector that has different dimensions than an RJ-45 connector. The connector that mates with the connector assembly 100 may be referred to herein as a mating connector.

The connector assembly 100 has a body 124 that is elongated along a longitudinal axis 106. The body 124 has an approximate "U" shape, or the shape of a partially flattened, upside-down "U." The body 124 extends along the longitudinal axis 106 between opposite exterior front and back ends 102, 104. The front end 102 includes a cavity 108 that receives the mating connector (not shown), such as an RJ-45 connector. The body 124 extends along a lateral axis 114 between opposite sides 110, 112. The longitudinal and lateral axes 106, 114 are perpendicular to one another in the embodiment shown in FIG. 1. The body 124 includes several interconnected sections 116, 118, 120. Alternatively, a different number of sections 116, 118, 120 may be provided. The sections 116, 118, 120 include a mating section 116, a raised section 118, and a mounting section 120. As described below, when the body 124 is mounted to the circuit board 130, the raised section 118 is suspended above and spaced apart from the circuit board 130 such that additional electronic components may be mounted to the circuit board 130 underneath the connector assembly 100 between the mating and mounting sections 116, 120.

The mating section 116 extends along the longitudinal axis 106 from the front end 102 to an opposite interior front end 126. The interior front end 126 represents a two-dimensional plane that is oriented parallel to the exterior front end 102. The interior front end 126 defines the intersection between the mating section 116 and the raised section 118. The raised section 118 extends along the longitudinal axis 106 from the interior front end 126 to an opposite interior back end 128. The interior back end 128 represents a two-dimensional plane that is oriented parallel to the exterior back end 104. The interior back end 128 defines the intersection of the raised section 118 and the mounting section 120. The mounting section 120 extends along the longitudinal axis 106 from the interior back end 128 to the exterior back end 104.

The mating section 116 receives the mating connector (not shown) to couple the mating connector with the body 124. The mounting section 120 is mounted to the circuit board 130 to couple the connector assembly 100 with the circuit board 130. The body 124 includes contacts 122, 218 (shown in FIG. 2) that are at least partially disposed within the body 124. The contacts 218 mate with corresponding contacts (not shown) in the mating connector that is received in the front end 102. The contacts 122 protrude from the bottom surface 144 of the connector assembly 100 near the back end 104. The protruding portions of the contacts 122 are inserted into openings or vias (not shown) in the circuit board 130 to mount the connector assembly 100 to the circuit board 130. The contacts 122 electrically couple the contacts of the mating connector with the circuit board 130.

The mating, raised, and mounting sections 116, 118, 120 extend along a lateral axis 114 between opposite sides 110, 112. In the illustrated embodiment, each of the sides 110, 112 is common to the mating, raised, and mounting sections 116, 118, 120. For example, all of the mating, raised, and mounting sections 116, 118, 120 extend between the two-dimensional planes defined by the sides 110, 112 along the lateral axis 114.

The body 124 extends along a vertical axis 134 from a top side 136 to a bottom side 158. Each of the mating, raised, and mounting sections 116, 118, 120 includes a top surface 160, 162, 164 that encompasses a different, non-overlapping portion of the top side 136. For example, the top surfaces 160, 162, 164 may be adjacent to one another and coplanar with one another. The mating, raised, and mounting sections 116, 118, 120 extend along the vertical axis 134 from the top surfaces 160, 162, 164 to corresponding bottom surfaces 138, 140, 142, 144. The bottom surfaces 138, 140, 142, 144 are different, non-overlapping portions of the bottom side 158. As shown in FIG. 1, the mating section 116 includes the bottom surfaces 138, 140, the raised section 116 includes the bottom surface 142, and the mounting section 120 includes the bottom surface 144.

The bottom surfaces 138, 140, 142, 144 may define or reside in different two-dimensional planes that are parallel to each other. The bottom surfaces 138, 140 of the mating section 116 are non-coplanar. For example, the bottom surfaces 138, 140 may not be disposed in the same two-dimensional plane. The bottom surfaces 138, 140 may be separated from one another by a flange 146 that extends around the perimeter of the mating section 116. Alternatively, the flange 146 may be absent from the connector assembly 100. The bottom surface 140 may engage a top surface 148 of the circuit board 130 and the bottom surface 138 may overhang or project beyond an edge 150 of the circuit board 130 when the connector assembly 100 is mounted to the circuit board 130. Alternatively, both of the bottom surfaces 138, 140 may engage the circuit board 130 when the connector assembly 100 is mounted to the circuit board 130. For example, the connector assembly 100 may not include the flange 146 and the bottom surfaces 138, 140 may be coplanar and both engage the top surface 148 of the circuit board 130.

The bottom surface 142 of the raised section 118 is suspended above the circuit board 130 when the connector assembly 100 is mounted to the circuit board 130. The bottom surface 144 of the mounting section 120 engages the top surface 148 of the circuit board 130 when the connector assembly 100 is mounted to the circuit board 130. The contacts 122 project from the bottom surface 144 such that the contacts 122 may be received in the circuit board 130. As shown in FIG. 1, the front end 102 that receives the mating connector and the bottom surface 144 that is mounted to the circuit board 130 are oriented perpendicular to one another. Alternatively, the front end 102 and bottom surface 144 may be obliquely oriented or parallel with respect to one another.

In the illustrated embodiment, the body 124 includes an exterior electromagnetic shield 132. The shield 132 includes, or is formed from, a conductive material such as one or more metals or metal alloys. The shield 132 extends around all or substantially all of the mating, raised, and mounting sections 116, 118, 120 but for the cavity 108 in the mating section 116 and the bottom surface 144 of the mounting section 120. The shield 132 may not enclose the cavity 108 to permit the mating connector (not shown) to be received in the mating section 116. The shield 132 may not cover the bottom surface 144 of the mounting section 120 to permit the contacts 122 to protrude from the mounting section 120.

In the illustrated embodiment, the connector assembly 100 includes two light pipes 154. Two light sources 152 may be disposed inside the connector assembly 100. Alternatively, the light sources 152 may be located outside of the connector assembly 100. The light sources 152 are shown schematically as squares, but represent devices that generate light, such as Light Emitting Diodes (LEDs). In another embodiment, a different number of light sources 152 and/or light pipes 154 may be provided. The light pipes 154 extend from the light sources 152 through the mating section 116 to the front end 102. As shown in the illustrated embodiment, the light pipes 154 are elongated bodies that are oriented at an oblique angle with respect to the bottom surface 142 of the raised section 118. The light pipes 154 are comprised of light transmissive materials that convey light emitted from the light sources 152 through the mating section 116 to the front end 102. The light pipes 154 terminate at a corresponding signal surface 156. The signal surfaces 156 represent surfaces from which light is emitted out of the light pipes 154. In the illustrated embodiment, the signal surfaces 156 are disposed on a lower section of the front end 102. Alternatively, the signal surfaces 156 may be located elsewhere in the mating section 116. The signal surfaces 156 are located in positions that are visible to a user that is viewing the front end 102 of the connector assembly 100. The light sources 152 provide visual indicia related to the connector assembly 100. For example, the light sources 152 may generate light that propagates through the light pipes 154 and is visible to a user viewing the front end 102 when a mating connector (not shown) is coupled with the connector assembly 100. In another example, the light sources 152 may generate light when data signals are communicated between the mating connector and the connector assembly 100.

Figure 2:
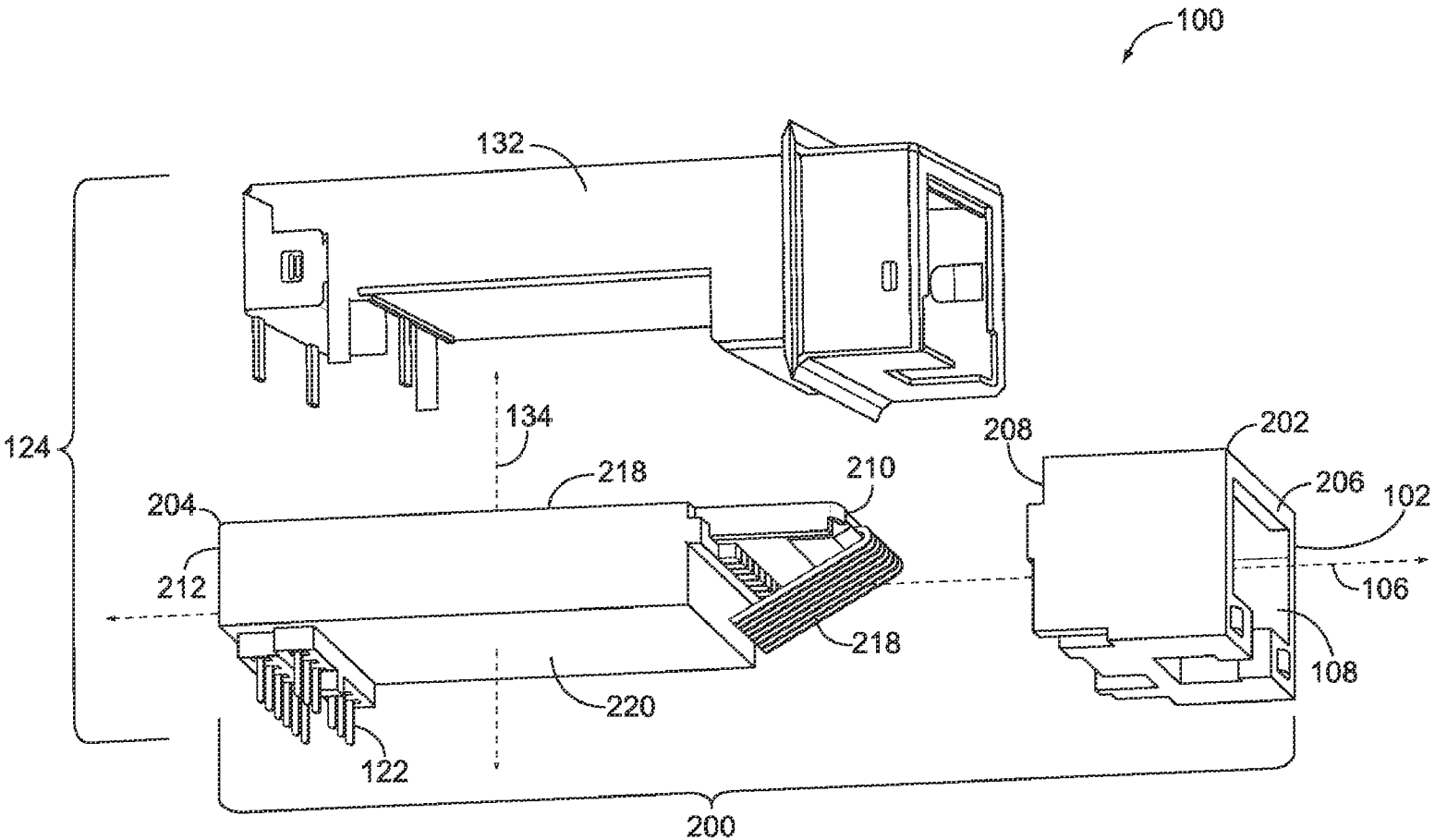
FIG. 2 is an exploded view of the connector assembly shown in FIG. 1 in accordance with one embodiment of the present disclosure.

FIG. 2 is an exploded view of the connector assembly 100 in accordance with one embodiment of the present disclosure. The body 124 of the connector assembly 100 includes a housing 200 that comprises a front section 202 and a rear section 204. The front and rear sections 202, 204 are coupled with one another and disposed within the shield 132. Alternatively, the front and rear sections 202, 204 may be formed as a single, integrated section or unitary body. The front and rear sections 202, 204 may include, or be formed from, dielectric materials, such as one or more polymers. The rear section 204 may include passive electronic components, active electronic components, or any combination of the two.

The front section 202 extends along the longitudinal axis 106 from a front end 206 to an opposite rear end 208. The front end 206 may be approximately coextensive with the front end 102 (shown in FIG. 1) of the body 124. For example, the front end 102 includes the portion of the shield 132 that extends across the exterior of the front end 206 of the front section 202. The front section 202 includes the cavity 108 that receives the mating connector (not shown). The cavity 108 extends through the front section 202 from the front end 206 to the rear end 208. In the illustrated embodiment, the mating section 116 (shown in FIG. 1) includes the front section 202. The front section 202 may define the mating section 116 such that the mating section 116 extends from the front end 206 to the rear end 208 along the longitudinal axis 106.

The rear end 208 of the front section 202 couples with the rear section 204 of the housing 200 to join the front section 202 with the rear section 204. The rear section 204 extends along the longitudinal axis 106 from a front end 210 to an opposite rear end 212. The rear section 204 extends from a top side 218 to an opposite bottom side 220 along the vertical axis 134. In the illustrated embodiment, the rear section 204 includes the raised section 118 (shown in FIG. 1) and the mounting section 120 (shown in FIG. 1). For example, the rear section 204 may define the raised and mounting sections 118, 120 such that the raised and mounting sections 118, 120 extend from the front end 210 to the rear end 212 along the longitudinal axis 106.

The contacts 122, 218 are held in and extend through the rear section 204 of the housing 200. The contacts 218 protrude from the front end 210 and the contacts 122 protrude from the bottom side 220. The contacts 218 mate with contacts (not shown) of the mating connector (not shown) when the mating connector is received in the front section 202. In the illustrated embodiment, the contacts 122 project from the bottom side 220 near the location where the bottom side 220 intersects the rear end 212. The contacts 122 are received in cavities 502 (shown in FIG. 5) of the circuit board 130 (shown in FIG. 1). The contacts 122, 218 may be electrically coupled with one or more internal components of the connector assembly 100 (not shown). Alternatively, the contacts 122, 218 may represent different sections of the same contacts. For example, several contacts may be held in the rear section 204 with a portion of each of the contacts protruding from the front end 210 (as contacts 218) and an opposite portion of each of the contacts protruding from the bottom side 220 (as contacts 122).

The front and rear sections 202, 204 are joined together inside the shield 132. As described above, the shield 132 encloses a majority of the housing 200. For example, the shield 132 may have a shape that substantially conforms to the exterior of the front and rear sections 202, 204 when the front and rear sections 202, 204 are combined. The shield 132 encloses the housing 200 so as to shield the contacts 122, 218 from electromagnetic interference and/or to shield nearby electronic components (not shown) from electromagnetic interference generated by the connector assembly 100.

Figure 3:
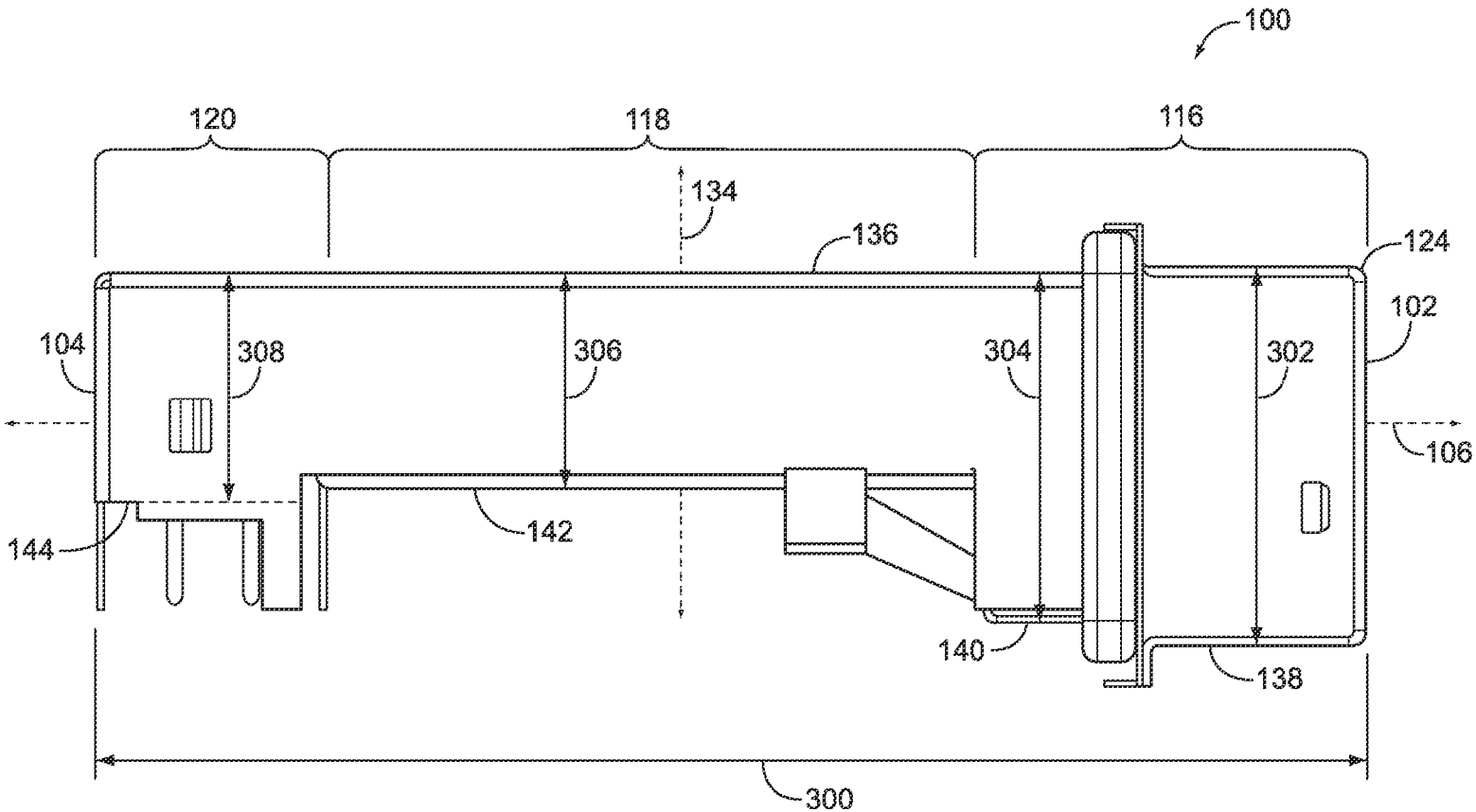
FIG. 3 is an elevational view of the connector assembly shown in FIG. 1 in accordance with one embodiment of the present disclosure.

FIG. 3 is an elevational view of the connector assembly 100 in accordance with one embodiment of the present disclosure. The body 124 of the connector assembly 100 extends along an outer length dimension 300 between the front end 102 and the back end 104 along the longitudinal axis 106. The body 124 is staged in height along the length dimension 300 to form the mating, raised, and mounting sections 116, 118, 120. For example, in the illustrated embodiment, the mating, raised, and mounting sections 116, 118, 120 have different height dimensions 302, 304, 306, 308. The height dimensions 302, 304, 306, 308 are measured parallel to the vertical axis 134 and extend between the top side 136 and the bottom surfaces 138, 140, 142, 144 of the corresponding section 116, 118, 120. As shown in FIG. 3, the height dimension 302 of the mating section 116 extends from the top side 136 to the bottom surface 138 and the height dimension 304 of the mating section 116 extends from the top side 136 to the bottom surface 140. The height dimension 302 is larger than the height dimension 304, although the height dimension 302 may be smaller or the same size as the height dimension 304 in another embodiment.

The height dimension 306 of the raised section 118 extends from the top side 136 to the bottom surface 142. The height dimension 308 of the mounting section 120 extends from the top side 136 to the bottom surface 144. In the illustrated embodiment, the height dimension 306 of the raised section 118 is smaller than the height dimensions 302, 304, 308 of the mating and mounting sections 116, 120. The bottom surface 144 of the mounting section 120 may engage the top surface 148 (shown in FIG. 1) of the circuit board 130 (shown in FIG. 1). When the connector assembly 100 is mounted to the circuit board 130, the raised section 118 is suspended above the circuit board 130 due to the smaller height dimension 306 of the raised section 118 relative to the height dimensions 304, 308 of the mating and mounting sections 116, 120.

Figure 4:
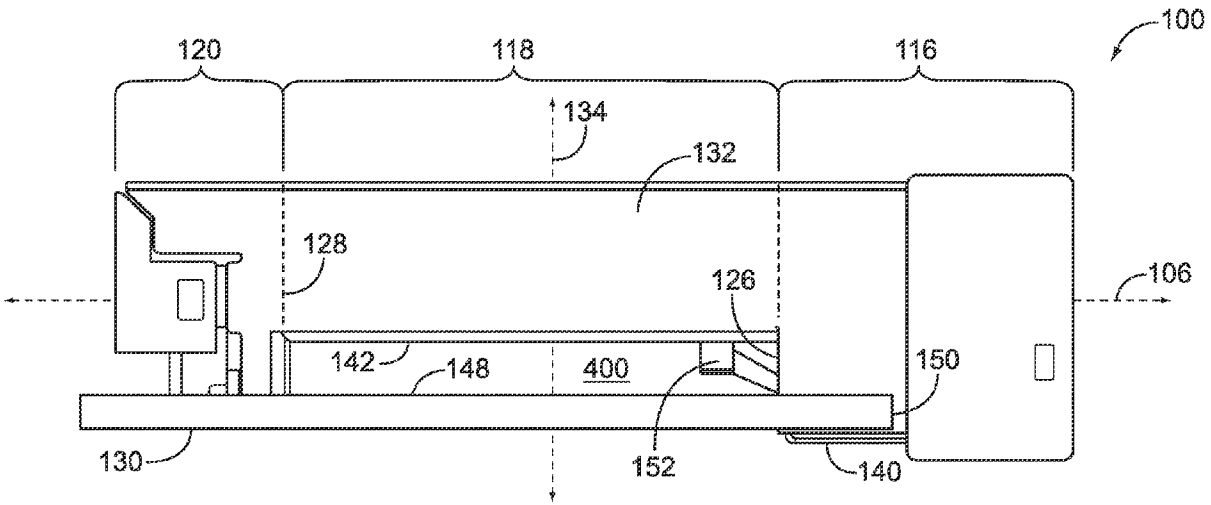
FIG. 4 is an elevational view of the connector assembly shown in FIG. 1 mounted to a circuit board also shown in FIG. 1 in accordance with one embodiment of the present disclosure.

FIG. 4 is an elevational view of the connector assembly 100 mounted to the circuit board 130 in accordance with one embodiment of the present disclosure. As shown in FIG. 4, the raised section 118 is suspended above the circuit board 130. The volume or space between connector assembly 100 and the circuit board 130 may be referred to as a component retention tunnel 400. The tunnel 400 is a gap or opening that laterally traverses between the connector assembly 100 and the circuit board 130. The tunnel 400 is bounded by the mating section 116 and the mounting section 120 in a direction along the longitudinal axis 106. For example, the tunnel 400 longitudinally extends from the interior front end 126 at the intersection between the mating and raised sections 116, 118 to the interior back end 128 at the intersection between the raised and mounting sections 118, 120 along the longitudinal axis 106. The tunnel 400 vertically extends from the top surface 148 of the circuit board 130 to the bottom surface 142 of the raised section 118 along the vertical axis 134.

The tunnel 400 provides an open volume between the connector assembly 100 and the circuit board 130 that may be used for other electrical components. For example, the tunnel 400 may provide space for electronic components, such as the light sources 152 to be placed between the connector assembly 100 and the circuit board 130. Alternatively, light sources (not shown) or other components may be mounted to the circuit board 130 in the tunnel 400 beneath the raised section 118. The tunnel 400 allows the electronic components to be placed between the connector assembly 100 and the circuit board 130 without consuming additional real estate on the circuit board 130. For example, instead of mounting other components to the circuit board 130 outside of the footprint of the connector assembly 100, the tunnel 400 permits the components to be mounted to the circuit board 130 within the footprint of the connector assembly 100.

The shield 132 may dissipate thermal energy generated by the light sources 152 and/or other electronic components located within the tunnel 400. For example, thermal energy generated by the light sources 152 may be conducted and spread out by the shield 132 from a location within the tunnel 400 to locations outside of the tunnel 400. The shield 132 conveys at least some of the thermal energy generated by the light sources 152 or other components outside of the tunnel 400 to avoid overheating the light sources 152 or components.

Figure 5:
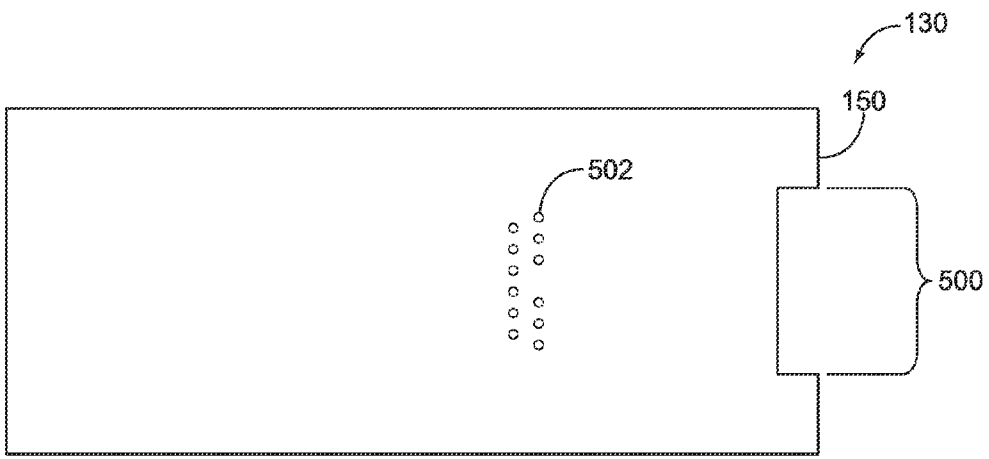
FIG. 5 is a bottom view of the circuit board shown in FIG. 1 in accordance with one embodiment of the present disclosure.

FIG. 5 is a bottom view of the circuit board 130 in accordance with one embodiment of the present disclosure. As shown in FIG. 5, the circuit board 130 includes several cavities 502 into which the contacts 122 (shown in FIG. 1) may be inserted to mount the connector assembly 100 (shown in FIG. 1) to the circuit board 130. Alternatively, the circuit board 130 may include pads (not shown) on the top surface 148 (shown in FIG. 1) to allow the contacts 122 to be coupled with the circuit board 130 using a surface mount solder method.

The circuit board 130 includes an opening 500 that inwardly extends from the edge 150. As shown in FIG. 5, the opening 500 extends through the circuit board 130. In one embodiment, the mating section 116 (shown in FIG. 1) of the connector assembly 100 (shown in FIG. 1) is disposed within the opening 500 when the connector assembly 100 is mounted to the circuit board 130. For example, the mating section 116 may extend through the opening 500 and project through the circuit board 130. As shown in the elevational view of FIG. 4, the portion of the mating section 116 that includes the bottom surface 140 is disposed in or through the opening 500 while the remaining portion of the mating section 116 protrudes past the edge 150.

As described above, the raised section 118 (shown in FIG. 1) of the connector assembly 100 (shown in FIG. 1) is suspended above the circuit board 130. Suspending the raised section 118 above the circuit board 130 may reduce the size of the opening 500, or the amount of the circuit board 130 that is removed to create the opening 500. For example, instead of the majority of the length dimension 300 (shown in FIG. 3) of the connector assembly 100 extending through the opening 500, a smaller portion of the connector assembly 100 extends through the opening 500. As a result, less of the circuit board 130 is removed to mount the connector assembly 100 to the circuit board 130 and more of the circuit board 130 is available to mount additional electronic components.

Figure 6:
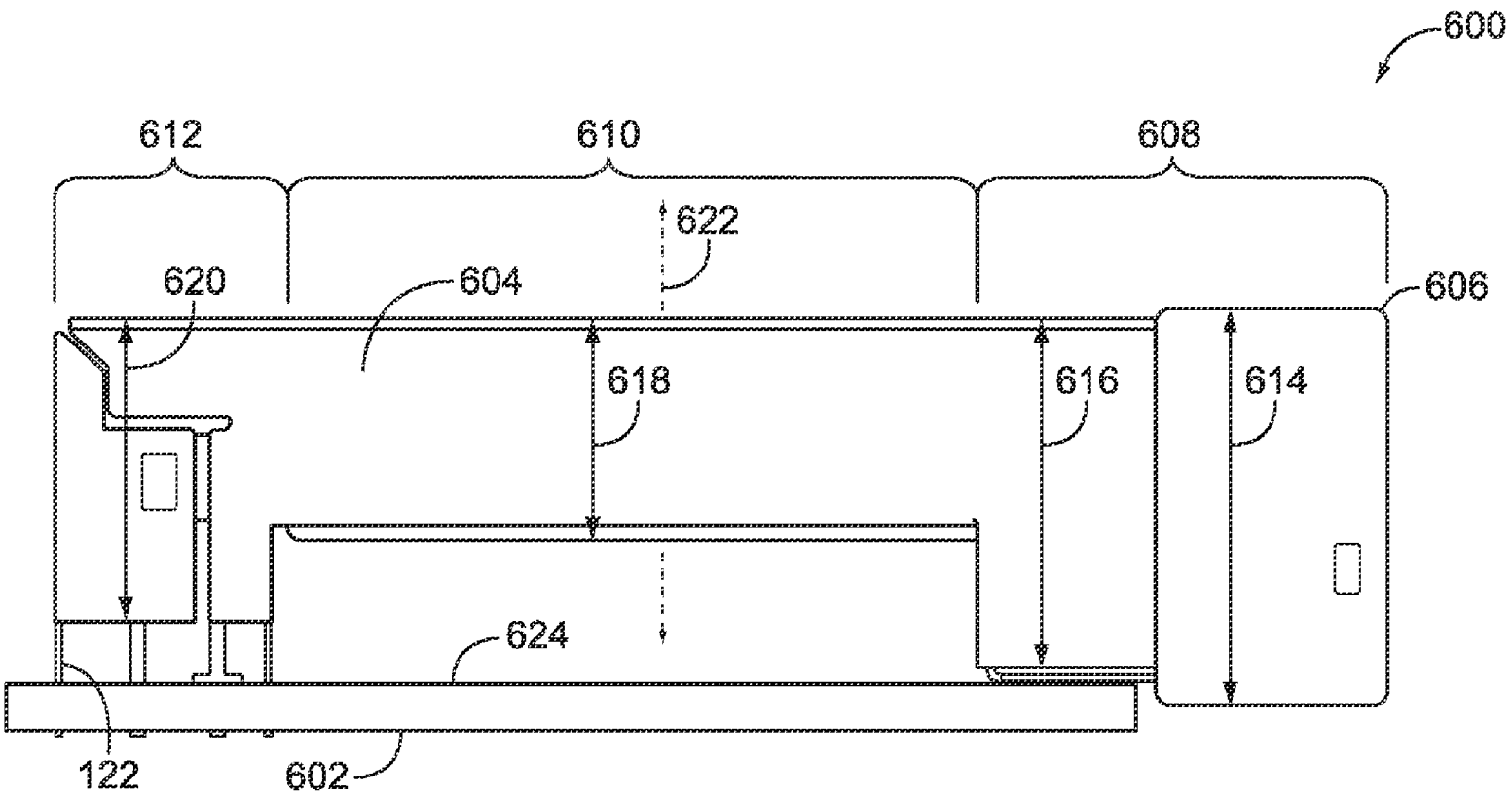
FIG. 6 is an elevational view of a connector assembly mounted to a circuit board in accordance with another embodiment of the present disclosure.

FIG. 6 is an elevational view of a connector assembly 600 mounted to a circuit board 602 in accordance with another embodiment of the present disclosure. The connector assembly 600 may be similar to the connector assembly 100 (shown in FIG. 1). For example, the connector assembly 600 may be configured to receive a mating connector (not shown), such as an RJ-45 connector. The connector assembly 600 includes an exterior electromagnetic shield 604 that may be similar to the shield 132 (shown in FIG. 1). Several contacts (not shown) that are similar to the contacts 122, 218 (shown in FIGS. 1 and 2) are disposed within the connector assembly 600. The connector assembly 600 includes a body 606 that is staged in height dimensions to define a mating section 608, a raised section 610, and a mounting section 612. For example, the mating, raised, and mounting sections 608, 610, 612 have height dimensions 614, 616, 618, 620 that are measured along a vertical axis 622 of the body 606. Similar to the mating section 116 (shown in FIG. 1), the raised section 118 (shown in FIG. 1), and the mounting section 120 (shown in FIG. 1), the mating section 608 and the mounting section 612 have respective height dimensions 614, 616, 620 that are larger than the height dimension 618 of the raised section 610. When the connector assembly 600 is mounted to the circuit board 602, the raised section 610 is suspended above the circuit board 602 similar to the raised section 118.

In contrast to the connector assembly 100 (shown in FIG. 1), the connector assembly 600 does not extend through an opening in the circuit board 602. Instead, the mating section 608 and the mounting section 612 both engage an upper surface 624 of the circuit board 600. For example, the mounting section 612 may be mounted to the upper surface 624 while the mating section 608 rests on the upper surface 624. For example, the mounting section 612 may be in a fixed engagement with the upper surface 624 when the contacts 122 are loaded into the circuit board 602 such that the mounting section 612 is secured to the circuit board 602. The mating section 608 may rest on the upper surface 624 in that the mating section 608 does not include any protrusions, contacts, or other components that extend from the mating section 608 and are received or coupled to the circuit board 602 to secure the mating section 608 to the circuit board 602. Resting the mating section 608 on the circuit board 602 may eliminate the need to remove a portion of the circuit board 602 in order to accommodate the mating section 608.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a body extending along a longitudinal axis between front and back ends and along a vertical axis between a top surface and bottom surfaces, the body having a mating section, a raised section, and a mounting section, the mating section including the front end and configured to couple with a mating connector, the mounting section configured to be joined to a circuit board;

one or more contacts disposed in the body and configured to electrically couple with the mating connector and with the circuit board, wherein the raised section is spaced apart from and is suspended above the circuit board when the mounting section is mounted to the circuit board; and wherein the mating section and the mounting section each extend along the longitudinal axis between opposite first and second ends, the body establishing a through-tunnel between the body and the circuit board when the body is mounted to the circuit board, the through-tunnel bounded by the second end of the mating section, the first end of the mounting section, a bottom surface of the raised section, and the circuit board when the body is mounted to the circuit board.

2. The connector assembly of claim 1, wherein the body is staged in height dimensions along the vertical axis between the top surface and the bottom surfaces to define the mating section, the raised section, and the mounting section.

3. The connector assembly of claim 1, wherein the body extends along a lateral axis between opposite sides, the raised section defining the through-tunnel that laterally traverses the body between the bottom surface of the raised section and the circuit board.

4. The connector assembly of claim 3, wherein the through-tunnel is bounded by the mating section and the mounting section along the longitudinal axis and by the raised section and the circuit board along the vertical axis when the body is mounted to the circuit board.

5. The connector assembly of claim 1, wherein the body includes a housing having separate front and rear sections that are joined with one another, the front section including the mating section of the body, the rear section including the raised section and the mounting section of the body.

6. The connector assembly of claim 1, wherein the front end of the mating section and the bottom surface of the mounting section are oriented perpendicular to one another.

7. The connector assembly of claim 1, further comprising a light source and a light pipe extending from the light source to the mating section, the light source configured to generate light and the light pipe configured to convey the light toward the front end of the body.

8. The connector assembly of claim 1, wherein the mounting section is configured to engage the circuit board while the mating section is configured to extend through an opening in the circuit board along an edge of the circuit board when the body is mounted to the circuit board.

9. The connector assembly of claim 1, wherein the mounting section is configured to be mounted to the circuit board while the mating section is configured to rest on the circuit board.

10. The connector assembly of claim 1, wherein the body includes a conductive electromagnetic shield disposed around an exterior of the mating, raised and mounting sections, the shield configured to dissipate thermal energy that is generated by electronic components disposed between the circuit board and the raised section of the body when the body is mounted to the circuit board.

11. A connector assembly comprising:

a body extending along a longitudinal axis between front and back ends and along a vertical axis between a top surface and bottom surfaces, the body having a top side and a bottom side, the body being staged in height dimensions along the vertical axis between the top side and the bottom surfaces to define a mating section, a raised section, and a mounting section, the mating section including the front end and configured to couple with a mating connector, the mounting section configured to be joined to a circuit board; and one or more contacts disposed in the body and configured to electrically couple with the mating connector and with the circuit board, wherein the bottom surface of the mounting section is configured to engage the circuit board when the body is mounted to the circuit board such that the raised section is suspended above and spaced apart from the circuit board and the body defines a component retention through-tunnel laterally traversing the body between the raised section and the circuit board.

12. The connector assembly of claim 11, wherein the body includes a housing having separate front and rear sections that are joined with one another, the front section including the mating section of the body, the rear section including the raised section and the mounting section of the body.

13. The connector assembly of claim 11, wherein the through-tunnel is bounded by the mating section and the mounting section along the longitudinal axis and by the raised section and the circuit board along the vertical axis when the body is mounted to the circuit board.

14. The connector assembly of claim 11, wherein the mating section and the mounting section each extend along the longitudinal axis between opposite first and second ends, the through-tunnel bounded by the second end of the mating section, the first end of the mounting section, the bottom surface of the raised section, and the circuit board when the body is mounted to the circuit board.

15. The connector assembly of claim 11, wherein the mounting section includes one of the bottom surfaces that is configured to be joined to the circuit board when the body is mounted to the circuit board, the front end of the mating section and the bottom side oriented perpendicular to one another.

16. The connector assembly of claim 11, further comprising a light source and a light pipe extending from the light source to the mating section, the light source configured to generate light and the light pipe configured to convey the light toward the front end of the body.

17. The connector assembly of claim 11, wherein the mounting section is configured to engage the circuit board while the mating section is configured to extend at through an opening in the circuit board along an edge of the circuit board when the body is mounted to the circuit board.

18. The connector assembly of claim 11, wherein the mounting section is configured to be mounted to the circuit board while the mating section is configured to rest on the circuit board.

19. The connector assembly of claim 11, further comprising a conductive electromagnetic shield disposed around an exterior of the mating, raised, and mounting sections, the shield configured to dissipate thermal energy that is generated by electronic components disposed between the circuit board and the raised section of the body when the body is mounted to the circuit board.

* * * * *